United States Patent [19]

Keller

[11] Patent Number: 4,892,295

[45] Date of Patent: Jan. 9, 1990

[54] PAPER CUTTING ASSIST

[76] Inventor: Jeanne N. Keller, 504 Gawain Ct., Virginia Beach, Va. 23464

[21] Appl. No.: 280,913

[22] Filed: Dec. 7, 1988

[51] Int. Cl.[4] ..... B25B 1/04

[52] U.S. Cl. ..... 269/8; 269/87.1; 269/254 MW

[58] Field of Search .... 269/254 R, 254 CS, 254 MW, 269/237, 239, 8, 276, 286, 274, 87, 87.1

[56] References Cited

U.S. PATENT DOCUMENTS

| | | | |
|---|---|---|---|
| 673,941 | 5/1901 | Bellas et al. . | |
| 1,875,410 | 9/1932 | Babcock | 269/254 MW |
| 2,666,352 | 1/1954 | Philips . | |
| 2,943,336 | 7/1960 | Barrett et al. | 269/254 MW |
| 3,065,960 | 11/1962 | Miller | 269/276 |
| 3,873,080 | 3/1975 | Bostic | 269/237 |
| 4,261,555 | 4/1981 | Adams | 269/254 R |

*Primary Examiner*—Robert C. Watson

*Attorney, Agent, or Firm*—Griffin, Branigan & Butler

[57] ABSTRACT

A paper cutting assist (10) for holding paper sheets (28) when they are being cut with scissors (64) comprises a relatively flat lid-jaw block (12) and a relatively flat base-jaw block (14) which are hinged together along hinge edges (20, 22) thereof and which include a lid-block jaw non-slip layer (32) mounted on a lid-jaw paper-gripping surface (24) and a base support non-slip layer (32) on a flat raised base support surface (26). The lid and base blocks are constructed of sufficiently heavy material that the non-slip layers prevent movement of the paper-cutting assist on the floor surface (54) and movement of a paper sheet (28) placed between the paper gripping surfaces of the lid and base blocks. Attracting magnets (38, 40, 42 and 44) can be placed in the lid and base blocks for providing additional bias to hold the blocks together.

10 Claims, 2 Drawing Sheets

PAPER CUTTING ASSIST

BACKGROUND OF THE INVENTION

This invention relates generally to the art of work holders, and is specifically concerned with a work holder for holding a sheet of paper while it is being cut with a pair of scissors.

A difficulty persons with one hand have is that of cutting a sheet of paper with scissors. In this regard, in order to cut a sheet of paper with a pair of scissors it is preferable that the sheet be held rather firmly in a spread, or open, configuration, so that the scissors can move along the paper while the blades thereof simultaneously open and close perpendicular to the paper for shearing it between them. Unfortunately, those having only one hand are not able to easily hold a sheet of paper in this cutting configuration while they simultaneously cut it with a pair of scissors. Thus, it is an object of this invention to provide a paper cutting assist which can be used by a one-handed person to hold a sheet of paper while he cuts it.

Some devices have been suggested for holding sheets of paper while they are being cut, however, such holders have been unduly large in size and clumsy in shape so that they cannot be easily moved from place-to-place. Normally, such devices have been intended to stay, and be used, in only one place. Such devices are not practical for persons who need to cut paper sheets at various locations. Therefore, it is an object of this invention to provide a paper cutfing assist for holding a sheet of paper while it is being cut with scissors which can be easily carried about by individuals and which can be used on almost any table or counter surface available.

Yet another difficulty with prior art paper sheet holders has been that they have been unduly complicated in structure and unduly expensive to manufacture. Therefore, it is still another object of this invention to provide a paper sheet holder for holding a sheet of paper while it is being cut with scissors which is uncomplicated, inexpensive, and pleasing in appearance.

SUMMARY

According to principles of this invention, lid and base blocks are hinged together so that flat paper-gripping surfaces thereof close on one another to be approximately in parallel contact, one to the other. A lid-block jaw non-slip layer is mounted on one of the paper gripping surfaces and a base support non-slip layer is mounted on a flat base support surface for contacting a floor surface supporting a base-jaw member. The lid and base blocks are constructed of a sufficiently heavy material such that when the base support surface of the base block is mounted on the floor surface and gripping surfaces of the lid and base blocks are closed on a sheet of paper, the weight of the lid and base-jaw members maintains the paper holder stationary on the floor surface and the sheet stationary up off of the floor structure in the paper holder to allow a user to cut the paper sheet with scissors. An additional layer of non-slip material can also be mounted on the other paper gripping surface and magnets can be placed in the blocks to provide additional biasing for holding the blocks together on the sheet of paper.

BRIEF DESCRIPTION OF THE DRAWINGS

The foregoing and other objects, features and advantages of the invention will be apparent from the following more particular description of the preferred embodiment of the invention, as illustrated in the accompanying drawings in which reference characters refer to the same parts throughout the different views. The drawings are not necessarily to scale, emphasis instead being placed upon illustrating principles of the invention in a clear manner.

DETAILED DESCRIPTION OF THE PREFERRED EMBODIMENT

Figure 5:
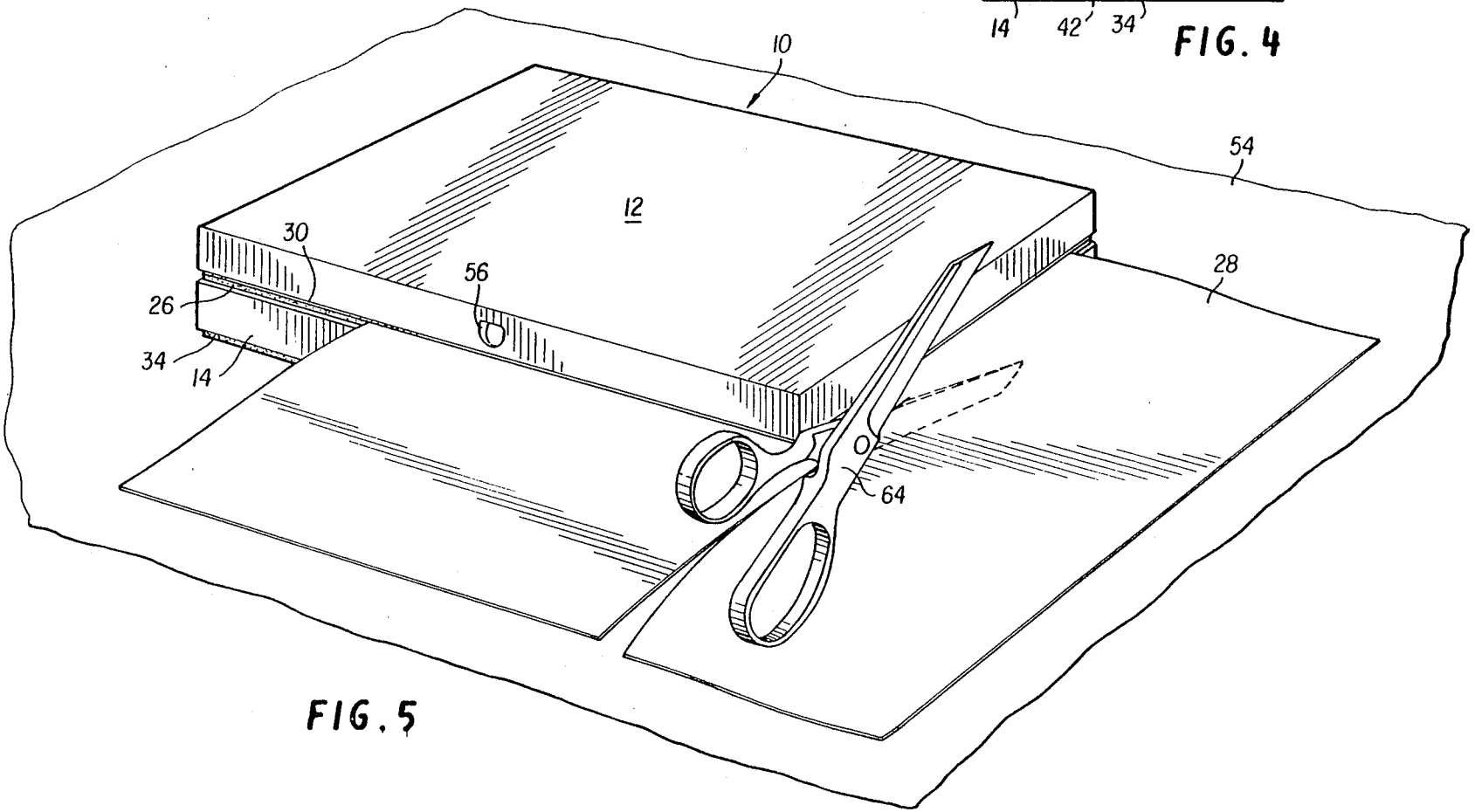
FIG. 5 is an isometric view of a second embodiment paper cutting assist of this invention resting on a floor surface and being closed on a sheet of paper while scissors are used to cut the paper.

A paper cutting assist 10 comprises a rectangularly-shaped, relatively flat, solid, lid block 12 and a rectangularly-shaped, relatively flat, solid, base block 14 which are hinged together by first and second hinges 16 and 18 attached at hinge edges 20 and 22 of the lid and base blocks 12 and 14. The lid block 14 has a lid-block paper-gripping surface 24 and the base block 14 has a base-block paper gripping surface 26 which can be closed approximately parallel on one another for gripping a sheet of paper 28 (see FIG. 5) therebetween by pivoting the lid block 12 on the hinges 16 and 18 relative to the base block 14. The lid- and base-block paper gripping surfaces 24 and 26 are flat in a preferred embodiment. At least one of the lid- or base-block paper gripping surfaces 24 or 26 has mounted thereon a non-slip layer of material. In the embodiment depicted in FIGS. 1–4, both of the paper-gripping surfaces 24 and 26 include such a non-slip layer while in the FIG. 5 embodiment only the lid paper gripping surface 24 has a lid-block jaw non-slip layer 30 thereon. With regard to the FIGS. 1–4 embodiment, a lid-block jaw non-slip layer 30 is mounted on the lid-block paper gripping surface 24 and a base-block jaw non-slip layer 32 layer is mounted on the base-block paper gripping surface 26.

Similarly, a flat base support non-slip layer 34 of non-slip material is mounted on a base support surface 36 of the base-block 14 Which is parallel to, and opposite to, the base-block paper-gripping surface 26. Although not shown in detail in the drawings, the base support surface 36, with the base support non-slip layer 34 mounted thereon, has the same general appearance as the base-block paper-gripping surface 26 with the base-block jaw non-slip layer 32 mounted thereon.

Figure 1:
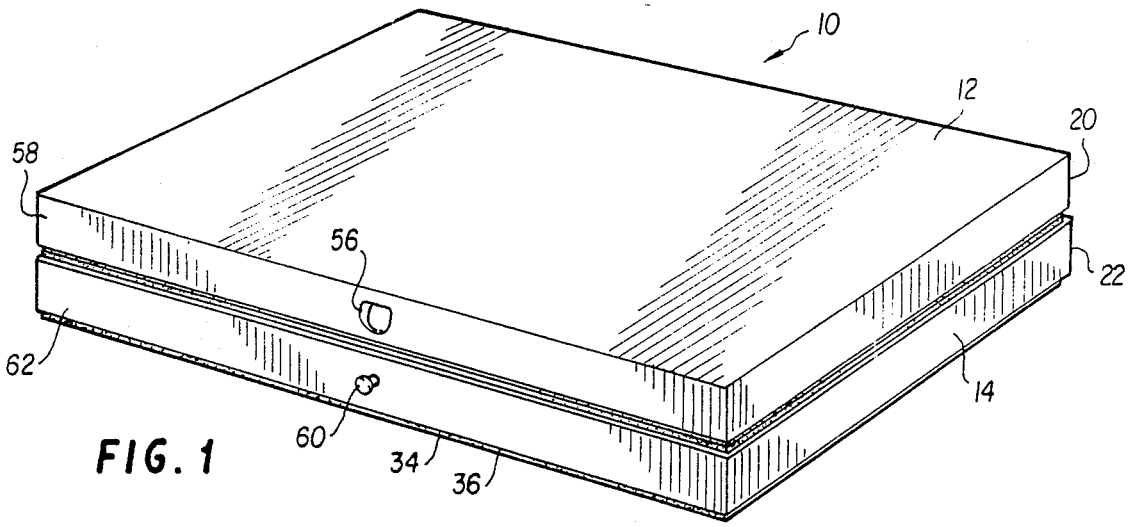
FIG. 1 is a front isometric view of a paper cutting assist of this invention.
Figure 2:
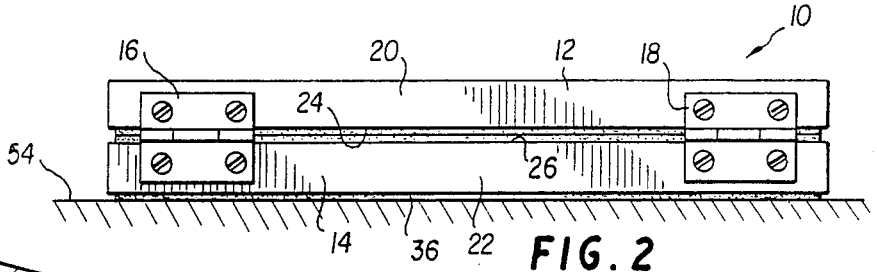
FIG. 2 is a elevational view of the paper cutting assist of FIG. 1 resting on a floor surface.
Figure 3:
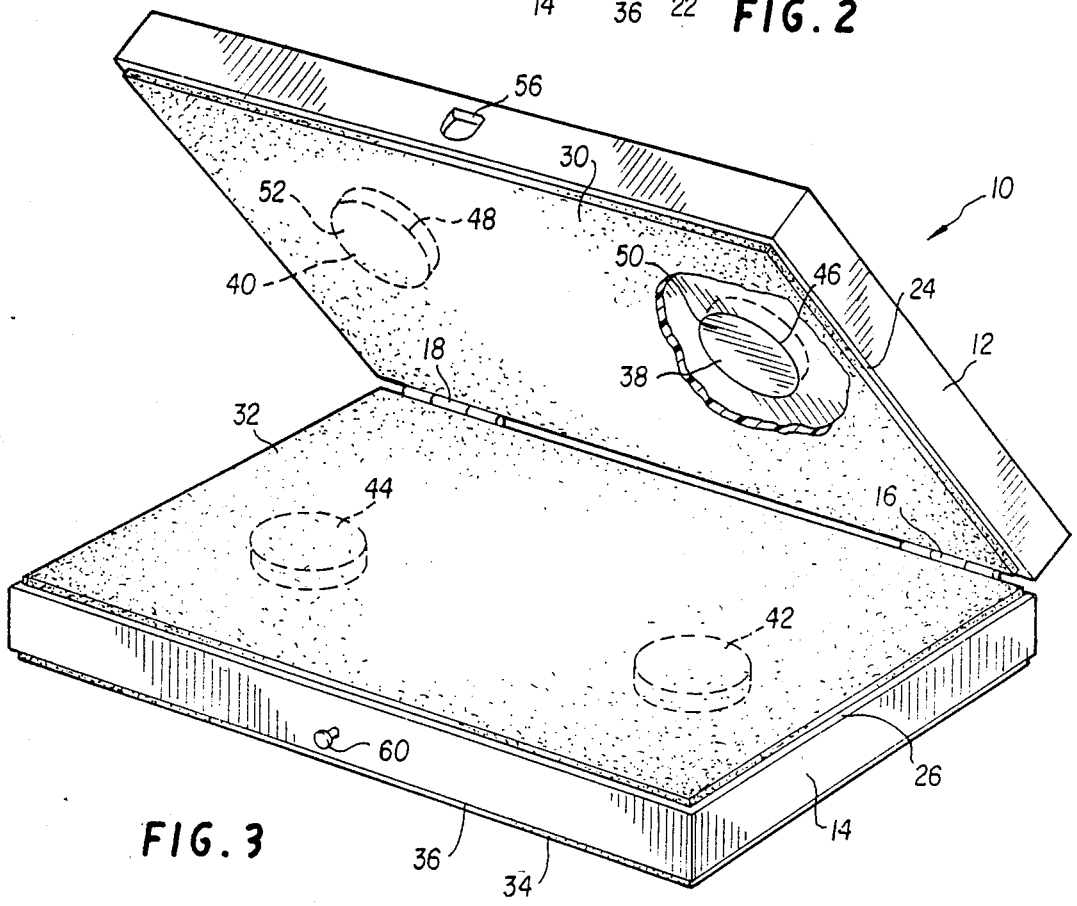
FIG. 3 is a partially, cut-away front isometric view of the paper cutting assist of FIG. 1 shown with blocks thereof pivoted away from one another so that paper-gripping surfaces are separated.
Figure 4:
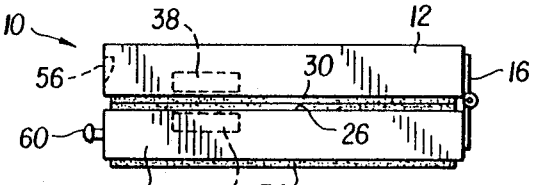
FIG. 4 is an end elevational view of the paper-cutting assist of FIG. 1.

Permanent-magnet discs 38, 40, 42 and 44 are mounted in the lid and base blocks 12 and 14 as is depicted in FIG. 3. In this regard, the magnet discs 38 and 40 are mounted in round holes 46 and 48 in the lid-block paper-gripping surface 24 so that surfaces 50 and 52 thereof are coplanar to the lid-block paper-gripping surface 24. That is, the round magnetic discs 38 and 40 do not extend beyond the lid-block paper-gripping surface 24. The magnets 42 and 44 are similarly inset in the base block 14 so that surfaces of the magnets are coplanar with the base-block paper-gripping surface 26. The lid-block jaw non-slip layer 30 and the base-block jaw non-slip layer 32 cover the magnets. Since the surfaces of the magnets are coplanar with the gripping surfaces 24 and 26, no bulge or indentation is created in the resilient lid-block and base-block non-slip layers 30 and 32. The magnet discs 38 and 40 in the lid block 12 are positioned to be exactly opposite their counterpart magnet discs 42 and 44 in the base-block 14 and the oppositely positioned magnet discs are oriented such that they attract one another. When the lid block 12 is closed on the base block 14 these magnet discs provide an additional bias for holding the blocks together.

As mentioned above, the lid and base blocks 12 and 14 are solid. In addition, they are constructed of a relatively dense, heavy substance, such as a heavy wood or a heavy resinous plastic. It would also be possible to construct these members of a metal. The rectangular lid and base blocks 12 and 14 are relatively flat in shape, and in one embodiment each has a length of 8½ inches and a width of 3⅛ inches. It has been determined that the paper cutting assist functions better when the width is at least 40% of the length. Each of the blocks 12 and 14 have a thickness of around ¾ inch in one embodiment so that the thickness of the paper cutting assist is about 1⅝ inches, the thickness of the jaw non-slip layers 30 and 32 being around 1/16 of an inch. The thickness of the base-block 14 should be between ¼ inch to 1 inch in order to allow scissors to easily pass between the floor surface 54 and the sheet of paper 28 held by the paper cutting assist 10. The non-slip layers 30, 32, and 34 are formed of a rubbery, flexible, tacky-to-the-feel, material. Various non-slip materials fitting this description are currently available, one being sold under the trademark DYCEM by Fred Sammons, Inc., and another being sold under the trademark SKIDTROL, by Maddak, Inc.

The lid block 12 has a grip indentation 56 in an edge 58 opposite the hinge edge 20 and the base block 14 has a protruding handle 60 extending from an edge 62 opposite the hinge edge 22. It is easy for a one-handed person, using the fingers of one hand, to engage the grip indentation 56 and the protruding handle 60 to separate the lid and base blocks 14 for rotating the lid block 12 away from the base block 14.

In operation, the paper cutting assist 10 is placed on a supporting floor (such as a table top) 54 with the base support non-slip layer 34 being in contact with the supporting floor 54. The lid block 12 is rotated away from the base block 14 on the hinges 16 and 18, as depicted in FIG. 3, and the sheet of paper 28 is placed on the base-block jaw non-slip layer 32 of the FIGS. 1–4 embodiment or directly on the base block paper gripping surface 26 of the FIG. 5 embodiment. Thereafter, the lid block 12 is rotated downwardly onto the base block 14 so that the sheet of paper 28 is clamped between the lid-block and base-block jaw non-slip layers 30 and 32 in the FIGS. 1–4 embodiment or between the lid-block jaw non-slip layer 30 and the base-block paper gripping surface 26 in the FIG. 5 embodiment.

Once the lid block 12 is closed with the sheet of paper 28 between the lid-block and base-block paper-gripping surfaces 24 and 26, the weight of the lid block causes sufficient friction between the sheet of paper 28 and the lid-block jaw non-slip layer 30 to prevent relative sliding of the sheet of paper out of the paper cutting assist 10. Similarly, the weight of the lid and base blocks 12 and 14 together, cause sufficient friction between the base support non-slip layer 34 and the supporting floor 54 that the paper cutting assist 10 is prevented from sliding thereon. In this configuration, a pair of scissors 64 can easily be used to cut the sheet of paper 28. It will be appreciated that the sheet of paper 28 could be placed in the paper cutting assist in various attitudes so that different portions of the sheet of paper 28 extend from the paper cutting assist for cutting with the scissors 64. The ¾ inch thickness of the base block 14 makes it easy to slide a scissor blade under the sheet of paper 28.

It will be appreciated by those of ordinary skill in the art that a person having one hand can easily manipulate the paper cutting assist 10 of this invention as well as a pair of scissors 64, all with one hand, to cut a sheet of paper 28. Further, it will be appreciated that the paper cutting assist is relatively small, can be used on virtually any surface, is inexpensive to manufacture, and easy to carry from place-to-place.

Tests have shown that the lid block should have a weight in the range of approximately 4 oz. to 16 oz. and that the paper cutting assist 10 should have a weight in the range of approximately 8 oz. to 24 oz.

While the invention has been particularly shown and described with reference to a preferred embodiment, it will be understood by those skilled in the art that various changes in form and detail may be made therein without departing from the spirit and scope of the invention. For example, as has already been mentioned above, it is not necessary to use both a lid-block and base-block jaw non-slip layers 30 and 32 if the weight of the lid block 12 is sufficient that only one jaw non-slip layer is needed. In this regard, one non-slip layer could be included either on the lid block 12 or the base block 14. It should be understood, that the gripping surfaces of the lid block and base block should contact parallel against one another, and their positions relative to the hinges 16 and 18 must be adjusted to achieve this depending on the thickness of non-slip layers mounted therebetween. In other words, the paper cutting assist should be arranged so that the lid block and the base block, and any non-slip gripping layers mounted thereon make simultaneous flat contact with paper gripped therebetween.

Further, where the lid block is sufficiently heavy, the magnetic discs 38-44 are not necessary, however, they do provide an additional biasing force holding the lid and base blocks 12 and 14 together for tightly holding paper sheets therebetween. The magnet discs should not be so strong that they make it unduly difficult for a one-handed person to separate the base and lid blocks 14 and 12 when they are closed with no paper therebetween.

In one embodiment of this invention the blocks are made of a heavy plastic with SKIDROL being on one of the top or base-block paper gripping surfaces 24 or 26. In this embodiment the base-block is 6 inches long, 3 inches wide, and ¾ inch thick.

The embodiments of the invention in which an exclusive property or privilege are claimed are defined as follows:

1. A paper cutting assist for holding paper sheets when they are being cut, said paper cutting assist comprising:

a relatively flat substantially rectangularly shaped lid block defining a flat lid-jaw paper gripping surface on one side thereof;

a relatively flat substantially rectangularly shaped base block defining a flat base support surface on a first side thereof for supporting said base jaw block from a floor surface and a flat base-jaw paper-gripping surface on an opposite side thereof both said lid block and said base block having substantially solid interiors, each having approximately the same length and width dimensions as the other, with the width dimensions being at least 40% of the length dimension so that outer edges of the lid and base blocks are relatively even to each other;

a hinge means for hingedly attaching said lid-jaw block to said base-jaw block at hinge edges of said lid- and base-jaw blocks for allowing said lid- and base-jaw blocks to freely pivot relative to one another such that said flat lid- and bottom-jaw paper gripping surfaces can be closed on one another to be approximately in parallel contact one-to-the-other, and so that they can be pivoted away from one another;

a separate jaw non-slip layer of non-slip material mounted on one of said lid- and base-jaw paper-gripping surfaces for contacting a paper sheet placed between said lid- and base-jaw paper-gripping surfaces when they are closed on one another to inhibit relative sliding between said paper sheet and said lid- and base-jaw paper-gripping surfaces; and, a base support non-slip layer of non-slip material mounted on said flat base support surface for contacting said floor surface to inhibit relative sliding between said floor surface and said flat base support surface;

wherein said lid- and base-blocks are constructed of a sufficiently heavy material such that when said base support surface with said base support non-slip layer is resting on said floor surface and said flat lid-jaw paper-gripping surface is closed on said base jaw paper-gripping surface, with a sheet of paper therebetween, the weight of said lid- and base-jaw members maintains said paper holder stationary on said floor surface and maintains said sheet stationary in said paper holder to allow a user to cut the paper sheet with scissors.

2. A paper cutting assist as in claim 1, wherein both said lid-jaw paper-gripping surface and said base-jaw paper-gripping surface have jaw non-slipping layers of non-slip material mounted thereon.

3. A paper cutting assist as in claim 2, wherein is further including an additional bias means for biasing said lid block toward said base block for helping to hold said sheet of paper therebetween.

4. A paper cutting assist as in claim 3, wherein said additional bias means comprises magnets mounted in said lid and base blocks for attracting one another.

5. A paper cutting assist as in claim 1, wherein is further including an additional bias means for biasing said lid block toward said base block for helping to hold said sheet of paper therebetween.

6. A paper cutting assist as in claim 5, wherein said additional bias means comprises magnets mounted in said lid and base blocks for attracting one another.

7. A paper cutting assist as in claim 1, wherein the length of said rectangular lid and base blocks is between eight and nine inches.

8. A paper cutting assist as in claim 7, wherein are further included gripping means mounted at edges of said lid and base blocks opposite said hinge edges for aiding in separating the two blocks.

9. A paper cutting assist as in claim 1, wherein are further included gripping means mounted at edges of said lid and base blocks opposite said hinge edges for aiding in separating the two blocks.

10. A paper cutting assist as in claim 1, wherein said base-block has a thickness between approximately ¼ inch to 1 inch in order to allow a scissors jaw to easily pass between said floor surface and said paper sheet held in said paper cutting assist.

* * * * *